US007481720B2

(12) United States Patent
Tavares

(10) Patent No.: US 7,481,720 B2
(45) Date of Patent: Jan. 27, 2009

(54) GOLF CLUB HEAD OR OTHER BALL STRIKING DEVICE WITH DISCRETE REGIONS OF DIFFERENT DENSITY

(75) Inventor: Gary G. Tavares, Azle, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/758,442

(22) Filed: Jun. 5, 2007

(65) Prior Publication Data

US 2007/0232407 A1 Oct. 4, 2007

Related U.S. Application Data

(63) Continuation of application No. 11/010,428, filed on Dec. 14, 2004, now Pat. No. 7,229,362.

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS

| | | | | |
|---|---|---|---|---|
| 3,873,090 | A | 3/1975 | Thompson | |
| 3,941,390 | A * | 3/1976 | Hussey | 473/292 |
| 4,204,684 | A | 5/1980 | Molitor | |
| 5,720,674 | A | 2/1998 | Galy | |
| 5,971,867 | A | 10/1999 | Galy | |
| 6,017,280 | A | 1/2000 | Hubert | |
| 6,217,461 | B1 | 4/2001 | Galy | |
| 6,244,976 | B1 | 6/2001 | Murphy et al. | |
| 6,248,025 | B1 | 6/2001 | Murphy et al. | |
| 6,280,349 | B1 | 8/2001 | Cook | |
| 6,332,847 | B2 | 12/2001 | Murphy et al. | |
| 6,386,990 | B1 | 5/2002 | Reyes et al. | |
| 6,406,378 | B1 | 6/2002 | Murphy et al. | |
| 6,406,381 | B2 | 6/2002 | Murphy et al. | |
| 6,425,832 | B2 | 7/2002 | Cackett et al. | |
| 6,435,980 | B1 | 8/2002 | Reyes et al. | |

(Continued)

FOREIGN PATENT DOCUMENTS

| | | | |
|---|---|---|---|
| JP | 07155410 | A | 6/1995 |

(Continued)

OTHER PUBLICATIONS

Jackson, Jeff. The Modern Guide to Clubmaking. Ohio: Dynacraft Golf Products, Inc., copyright 1994, p. 18-21.*

(Continued)

*Primary Examiner*—Eugene Kim
*Assistant Examiner*—Alvin A Hunter
(74) *Attorney, Agent, or Firm*—Banner & Witcoff, Ltd.

(57) ABSTRACT

Ball striking devices may include: (a) a sole member; (b) at least one intermediate body member; (c) a crown member; and (d) a face member. The materials making up the sole member, the intermediate body member(s), and the crown member may be selected so that the densities of the materials generally increase as one moves in a direction from the sole member toward the crown member. Such devices may be formed as golf club heads and/or golf clubs (such as "wood-type" golf clubs and golf club heads).

17 Claims, 3 Drawing Sheets

U.S. PATENT DOCUMENTS

| | | | | |
|---|---|---|---|---|
| 6,440,008 | B2 | 8/2002 | Murphy et al. | |
| 6,440,009 | B1 | 8/2002 | Guibaud et al. | |
| 6,450,894 | B1 | 9/2002 | Sun et al. | |
| 6,491,592 | B2 | 12/2002 | Cackett et al. | |
| 6,527,650 | B2 | 3/2003 | Reyes et al. | |
| 6,547,676 | B2 | 4/2003 | Cackett et al. | |
| 6,592,466 | B2 | 7/2003 | Helmstetter et al. | |
| 6,607,452 | B2 | 8/2003 | Helmstetter et al. | |
| 6,669,580 | B1 | 12/2003 | Cackett et al. | |
| 7,128,660 | B2 | 10/2006 | Gillig | |
| 7,172,519 | B2 * | 2/2007 | Byrne et al. | 473/349 |
| 2002/0187854 | A1 | 12/2002 | Ciasullo | |
| 2003/0236134 | A1 | 12/2003 | Nishitani | |
| 2004/0116208 | A1 | 6/2004 | De Shiell et al. | |
| 2004/0229713 | A1 | 11/2004 | Helmstetter et al. | |
| 2005/0096151 | A1 | 5/2005 | Hou et al. | |
| 2005/0239572 | A1 | 10/2005 | Roach et al. | |
| 2006/0014592 | A1 | 1/2006 | Sugimoto | |

FOREIGN PATENT DOCUMENTS

| | | | |
|---|---|---|---|
| JP | 11057085 | A | 3/1999 |
| JP | 2001212270 | A * | 8/2001 |

OTHER PUBLICATIONS

International Search Report in International Application No. PCT/US2005/044927, dated Apr. 27, 2006.

* cited by examiner

GOLF CLUB HEAD OR OTHER BALL STRIKING DEVICE WITH DISCRETE REGIONS OF DIFFERENT DENSITY

RELATED APPLICATION DATA

This application is a continuation of co-pending U.S. patent application Ser. No. 11/010,428 filed Dec. 14, 2004 in the name of Gary G. Tavares. This parent application is entirely incorporated herein by reference.

FIELD OF THE INVENTION

This invention relates generally to ball striking devices, such as golf clubs and golf club heads (including "wood-type" golf clubs and golf club heads, e.g., for drivers, fairway woods, hybrid or utility clubs, or the like), that have a low center of gravity to promote better playability.

BACKGROUND

Golf is enjoyed by a wide variety of players—players of different genders, and players of dramatically different ages and skill levels. Golf is somewhat unique in the sporting world in that such diverse collections of players can play together in golf events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world. The number of individuals participating in the game and the number of golf courses have increased steadily over recent years.

Golfers of all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite recent technological advances, "wood-type" golf clubs, particularly the driver, can be very difficult for some players to hit well. Accordingly, additional technological advances that improve a player's ability to get a golf ball airborne and improve the playability of wood-type golf clubs, particularly the driver, would be welcome in the golf world.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

In general, aspects of this invention relate to golf clubs, golf club heads, and/or other ball striking devices that have at least some portion of their weight distributed to low and rear areas of the device head (e.g., to provide a low center of gravity, to promote better playability, and to make it easier to get the ball up into the air during a stroke). Some more specific example aspects of this invention relate to ball striking devices, such as golf clubs and golf club heads, that include a multi-material, multi-layer construction, wherein the various layers are made from materials having different densities. For example, golf club heads (or other ball striking device heads or devices) in accordance with at least some examples of this invention may include: (a) a sole member made from a first material having a first density; (b) a first intermediate body member made from a second material having a second density, wherein the second density is less than the first density; (c) a crown member made from a third material having a third density, wherein the third density is less than the second density, and wherein the first intermediate body member is located between the sole member and the crown member; and (d) a face member, wherein the sole member, the first intermediate body member, and the crown member connect (directly or indirectly) to the face member.

Optionally, if desired, ball striking device heads or other devices in accordance with at least some example aspects of this invention may include a second intermediate body member (or even more intermediate body members) located between the first intermediate body member and the crown member. These additional intermediate body members may be connected to the face member and may be made from materials having a density lower than the second density and a decreasing density as one moves upward from the first intermediate body member toward the crown member.

Aspects of this invention also relate to golf clubs or other ball striking devices that include ball striking device head structures like those described above. Such ball striking devices may include, for example, a ball striking device head of the type described above, and a shaft extending from the ball striking device head. Additionally, if desired, ball striking devices in accordance with at least some examples of this invention further may include a grip element and/or some other type of handle member attached to and/or extending from the shaft.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
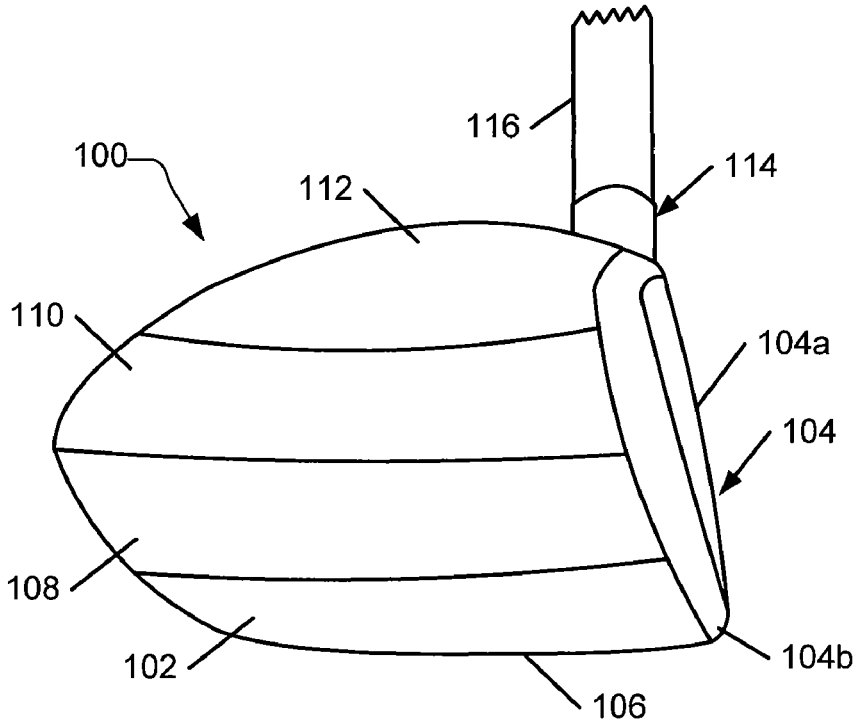
FIG. 1 illustrates an example "toe" view of a golf club head structure in accordance with examples of this invention.

In the following description of various example embodiments of the invention, reference is made to the accompanying drawings, which form a part hereof, and in which are shown by way of illustration various example structures, devices, systems, and environments in which aspects of the invention may be practiced. It is to be understood that other specific arrangements of parts, structures, example devices, systems, and environments may be utilized, and structural and functional modifications may be made without departing from the scope of the present invention. Also, while the terms "top," "bottom," "front," "back," "side," "underside," "overhead," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Ball Striking Devices According to Aspects of the Invention; Specific Examples of the Invention; and Conclusion.

A. Terms

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs (including "wood-type" golf clubs, hybrid or utility type clubs, irons, or putters), croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device that contacts the ball (or other object) in use. In some examples, such as golf clubs, the ball striking head typically will be a separate entity from any shaft member, and it will be attached to the shaft member in some manner.

B. General Description of Ball Striking Devices According to Aspects of the Invention In general, aspects of this invention relate to ball striking devices, such as golf club heads, golf clubs, and the like. Such ball striking devices, according to at least some examples of the invention, may include golf club heads that have their weight distributed to low and rear areas of the club head, e.g., to provide a low center of gravity, to promote better playability, and to make it easier to get the ball up into the air during a stroke.

Golf club heads (or other ball striking devices) in accordance with at least some examples of this invention may have a multi-material, multi-layer construction, wherein the various layers of the club head structure are made from materials having different densities. As a more specific example, golf club heads (or other ball striking devices) in accordance with at least some examples of this invention may include: (a) a sole member made, at least in part, from a first material having a first density; (b) a first intermediate body member made, at least in part, from a second material having a second density, wherein the second density is less than the first density; (c) a crown member made, at least in part, from a third material having a third density, wherein the third density is less than the second density, and wherein the first intermediate body member is located between the sole member and the crown member; and (d) a face member. The sole member, the first intermediate body member, and the crown member may connect (directly or indirectly) to the face member in at least some examples of the invention. Optionally, if desired, the face member may be integrally formed with at least a portion of the sole member, the crown member, or one or more of the body members without departing from this invention. In some examples, the face member may be made, at least in part, from a material having the same or a lower density than that of the sole member. In at least some examples, a major portion (i.e., ≧50%) of the sole member (by volume) will be made from the first material, a major portion of the first intermediate body member (by volume) will be made from the second material, and a major portion of the crown member (by volume) will be made from the third material.

Of course, any number of body members may be provided in a club head structure without departing from the invention. For example, at least some golf club heads or other ball striking devices in accordance with examples of this invention may include a second intermediate body member located between the first intermediate body member and the crown member. This second intermediate body member also may be connected to the face member and made, at least in part, from a fourth material having a fourth density, wherein the fourth density is less than the second density but greater than the third density (i.e., the second intermediate body member may be made, at least in part, from a material having a lower density than that of the first intermediate body member but a higher density than that of the crown member). In some examples, a major portion (i.e., ≧50%) of the second intermediate body member (by volume) will be made from the fourth material.

The various parts of the golf club head (or other ball striking device) may be made from any suitable or desired materials without departing from this invention, including conventional materials known and used in the art, such as steel (including stainless steel), titanium alloys, magnesium alloys, aluminum alloys, carbon fiber composite materials, glass fiber composite materials, carbon pre-preg materials, polymeric materials, and the like. The various parts may be produced in any suitable or desired manner without departing from the invention, including in conventional manners known and used in the art, such as by casting, forging, molding (e.g., injection or blow molding), etc. The various parts also may be held together as a unitary structure in any suitable or desired manner, including in conventional manners known and used in the art, such as using mechanical connectors, adhesives, cements, welding, and the like. Additionally, the various parts of the golf club head or other ball striking device (e.g., the sole member, the face member, the crown member, and/or the body members) may be constructed from one or more individual pieces, optionally pieces made from different materials having different densities, without departing from this invention. Optionally, in at least some examples of this invention, when a layer of a ball striking device structure is made from multiple pieces, optionally pieces of different materials, all or most (≧50% by volume) of the materials making up a given layer may have a higher density than the material(s) making up the layer immediately above it (if any) and/or all or most (≧50% by volume) of the materials making up a given layer may have a lower density that the material(s) making up the layer immediately below it (if any).

In at least some examples of the invention, the first material (i.e., that making up at least a portion of the sole member) may include at least one member selected from the group consisting of steel materials (including stainless steel materials), titanium alloys, polymeric materials, etc. As further examples, the second and/or fourth materials (i.e., those making up at least a portion of the first and/or second intermediate body members) each may include at least one member selected from the group consisting of magnesium alloys, titanium alloys, aluminum alloys, polymeric materials, etc. As still further examples, the third material (i.e., that making up at least a portion of the crown member) may include at least one member selected from the group consisting of carbon fiber composite materials, glass fiber composite materials, other composite materials, titanium alloy materials, carbon pre-pregs, polymeric materials, etc. The face member, in at least some examples of this invention, may be made, at least in part, from at least one member selected from the group consisting of titanium alloys, steel materials (including stainless steel materials), aluminum alloys, polymeric materials, etc. In some examples, the face member will be made, at least in part, from the same material(s) making up the sole member. Examples of polymeric materials that may be included in various parts of a club head structure include: thermoplastics (e.g., those suitable for use in injection or blow molding processes, such as thermoplastic polyurethanes, etc.), nylons, polyesters, and the like. If necessary or desired, the polymeric materials further may include metals or metal alloy components, e.g., to affect strength and/or to control weight or density. Of course, materials other than those specifically identified above, including conventional materials known and used in the art, may be used for the various parts of the golf club head (or other ball striking device structure) without departing from this invention.

Aspects of this invention also relate to golf clubs (or other ball striking devices) that include golf club head structures (or other ball striking device heads) described above. Such devices may include, for example, a club head (or other ball striking device head) of the type described above, and a shaft extending from the head. The shaft may be attached to the head in any suitable or desired manner, including in conventional manners known and used in the art, such as via adhesives, cements, welding, soldering, mechanical connectors (such as threads, retaining elements, or the like), etc. The shaft may be made from any suitable or desired materials, including conventional materials known and used in the art, such as graphite based materials, other composite materials, steel materials (including stainless steel), aluminum materials, other metal alloy materials, and the like.

Also, as is conventional, a grip element or other handle member may be attached to and/or extend from the shaft. Any desired grip materials may be used without departing from this invention, including rubber materials, leather materials, materials including cord or other fabric material embedded therein, polymeric materials, and the like. The grip element may be attached to the shaft in any suitable or desired manner, including in conventional manners known and used in the art, e.g., using adhesives or cements. For structures including a separate handle member extending from the shaft, the handle member may be connected to the shaft, directly or indirectly, in any suitable or desired manner, such as via welding, soldering, adhesives, mechanical connectors (such as threads, retaining elements, etc.), or the like.

Specific examples of the invention are described in more detail below. The reader should understand that these specific examples are set forth merely to illustrate examples of the invention, and they should not be construed as limiting the invention.

C. SPECIFIC EXAMPLES OF THE INVENTION

The various figures in this application illustrate examples of ball striking devices and components thereof useful in examples of this invention. When the same reference number appears in more than one drawing, that reference number is used consistently in this specification and the drawings to refer to the same part throughout.

At least some example embodiments of ball striking devices according to this invention relate to golf club head structures, including "wood-type" golf club heads, e.g., useful for drivers, fairway woods, utility or hybrid type clubs, or the like. Such club head structures may include a multiple piece construction and structure. Examples of ball striking devices according to this invention will be described in detail below in conjunction with the golf club head structure illustrated in FIGS. 1-5.

Figure 2:
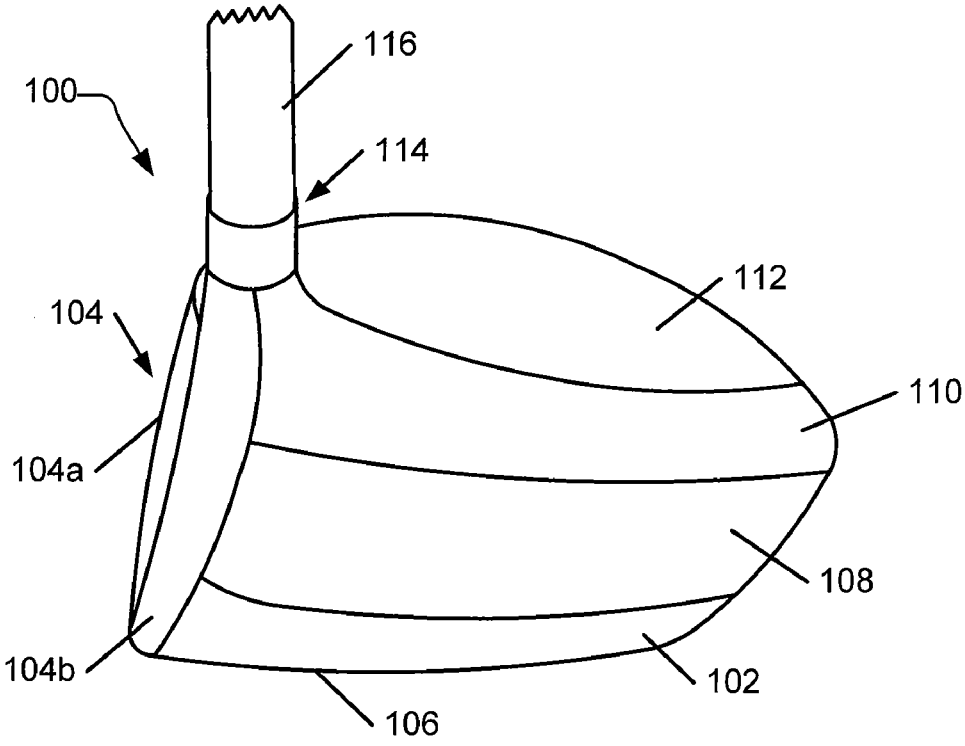
FIG. 2 illustrates an example "heel" view of a golf club head structure in accordance with examples of this invention.
Figure 3:
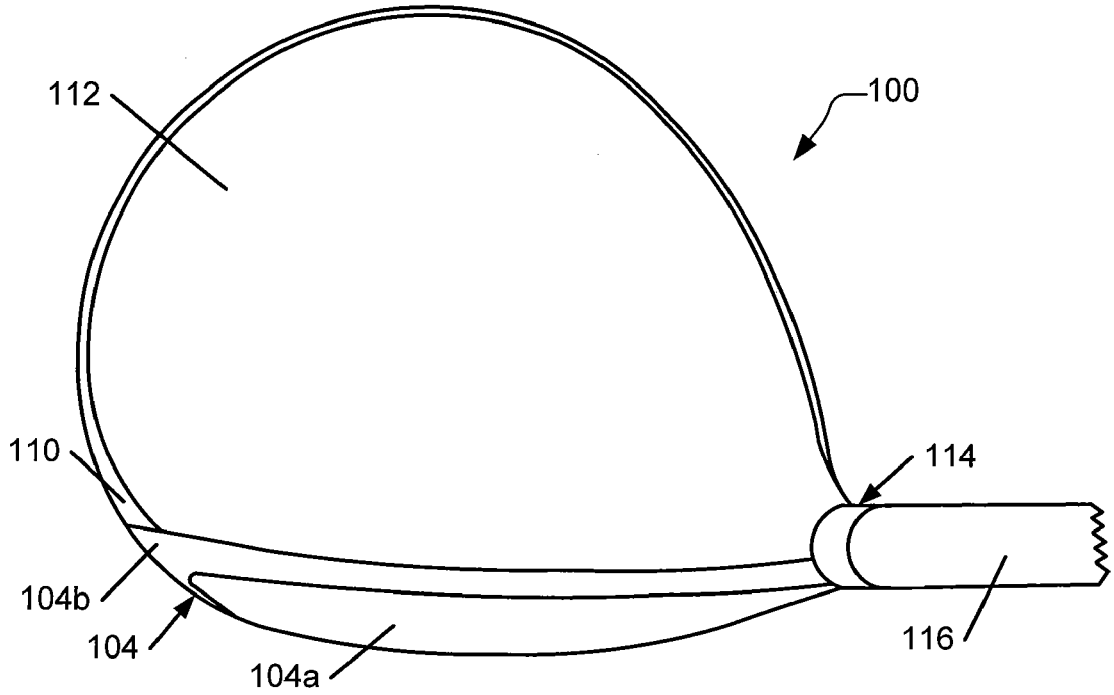
FIG. 3 illustrates an example overhead view of a golf club head structure in accordance with examples of this invention.
Figure 4:
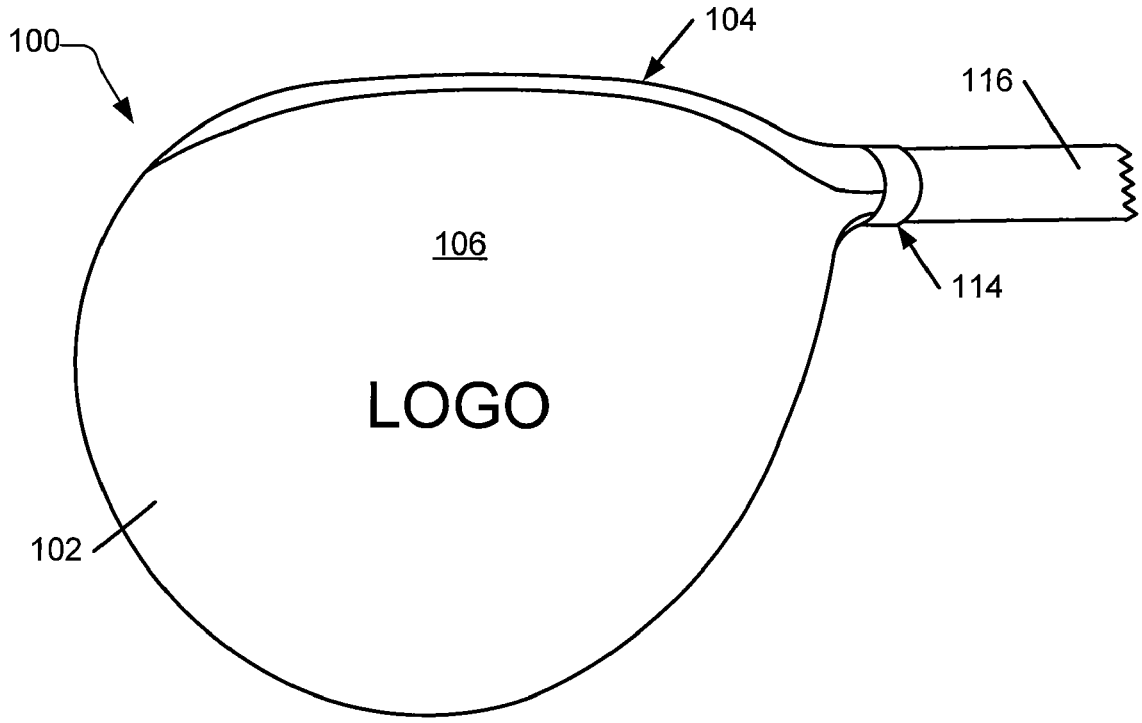
FIG. 4 illustrates an example underside view of a golf club head structure in accordance with examples of this invention.
Figure 5:
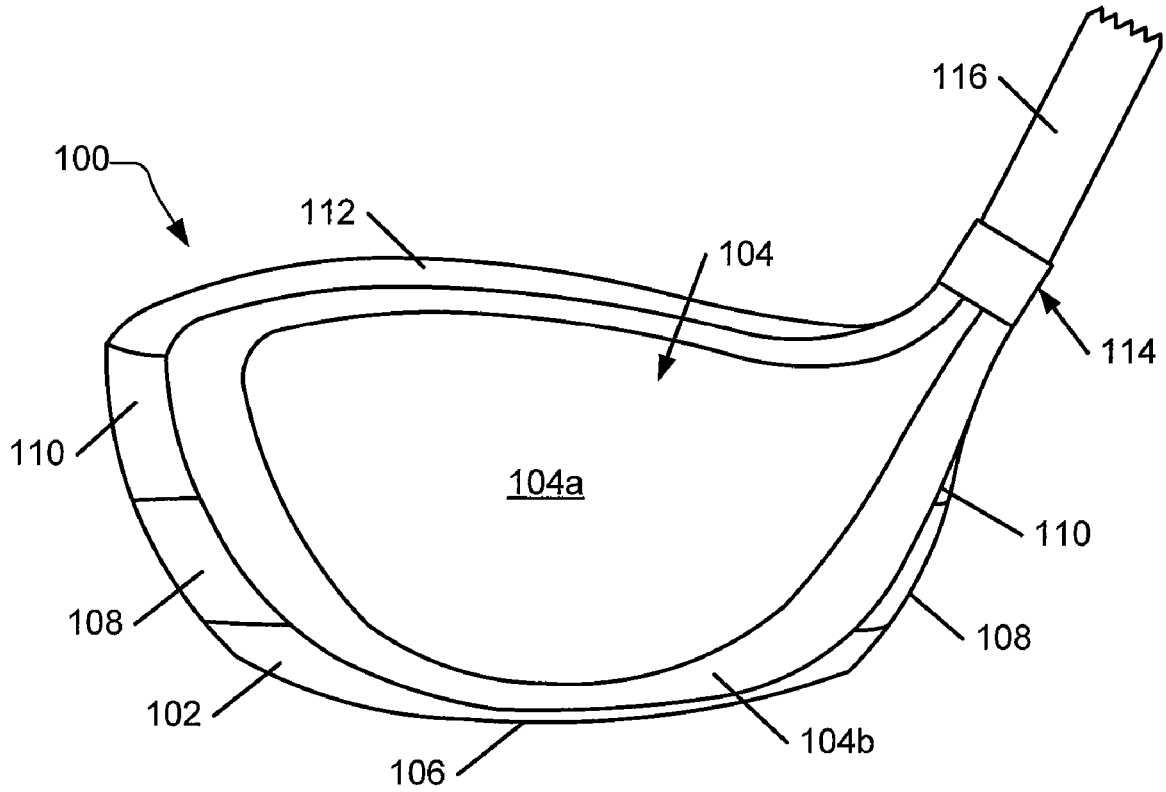
FIG. 5 illustrates an example front view of a golf club head structure in accordance with examples of this invention.

FIGS. 1-5 illustrate views of a golf club head structure 100 in accordance with examples of this invention from various directions. Specifically, FIG. 1 illustrates an example golf club head structure 100 from the "toe" end, and FIG. 2 illustrates an example golf club head structure 100 from the "heel" end. Additionally, FIG. 3 illustrates an overhead view, FIG. 4 illustrates a bottom view, and FIG. 5 illustrates a front view of an example golf club head structure 100 according to the invention.

As shown in the various figures, the club head structure 100 includes a sole member 102 (for example, a sole plate or other structure), which, in this example structure 100, is integrally formed as a unitary structure with face member 104 (for example, a face plate or other structure). At least the sole member 102, and optionally the face member 104, may be made from materials having the highest density in the overall golf club head structure 100 of this example. If desired, however, the face member 104 may be separate from the sole member 102, and/or optionally, it may be made from a material having a lower density than that of the sole member 102.

As more specific examples, in at least some examples of the invention, the sole member 102 (and optionally the face member 104) may be made from a steel material (including stainless steel) or a titanium alloy. Also, the sole member 102 and the face member 104 may be of conventional design and construction, and each may be made from multiple pieces or parts, if desired, without departing from the invention. For example, as illustrated in the figures, face member 104 may include a ball striking face 104*a* (optionally in multiple pieces), which may be mounted on a separate face member frame 104*b* (optionally made of multiple pieces), in at least some examples of this invention.

Because the overall club head structure 100 typically will be hollow or substantially hollow, the sole member 102, in at least some examples of this invention, may be formed as a shallow cup-shaped member with relatively thin side and bottom walls, wherein the bottom of the cup-shaped member forms the bottom surface 106 of the club head structure 100. While typically hollow, however, the club head structure 100 may include various internal structures, such as weighted members, face reinforcing members, shaft mounting structures, and/or other conventional elements that are known and used in the art.

In order to provide a low center of gravity in the overall club head structure 100, as noted above, the sole member 102 may be made from a material having a relatively high density in the overall club head structure 100 (e.g., often the highest density material in the club head structure 100). The club head structure 100 in accordance with at least some examples of this invention also may include various intermediate body members that form the mid-portion of the club head structure 100 (two body members 108 and 110 are illustrated in the example structure 100 of FIGS. 1-5). These intermediate body members 108 and 110 are provided between the sole member 102 and a crown member 112. The body members 108 and 110 may be formed from generally U-shaped bands or ribbons of material that extend around from one side of the face member 104 to the other and form the perimeter of the intermediate golf club head body.

To further help keep the center of gravity low in the overall club head structure 100, the intermediate body members 108 and 110 may be made from materials so as to have progressively lower densities as one moves upward in a direction from the sole member 102 toward the crown member 112. Accordingly, in at least some examples of the invention, the lower intermediate body member 108 may be made from a material having a higher density than the material making up the higher intermediate body member 110. If additional intermediate body members are included in the golf club head structure 100, this generally decreasing density pattern may continue as one moves in a direction in the club head structure 100 from the sole member 102 toward the crown member 112. The crown member 112 may be made from a lower density material as compared to that of the intermediate body members 108 and 110 and/or the sole member 102 in at least some examples of the invention. Indeed, in at least some examples, the crown member 112 may be made from the lowest density material in the overall club head structure 100.

If desired, in order to further help keep the overall center of gravity low and toward the rear of the golf club structure 100, one or more of the sole member 102, intermediate body members 108 and 110, and/or the crown member 112 of the club head structure 100 may be formed from multiple pieces of materials having different densities, wherein the densities of the various materials are lower toward the front of the golf club head structure 100 (i.e., toward the face member) and higher toward the rear of the club head structure 100. Additionally, the various pieces may have progressively lower densities as one moves in a direction from the sole member 102 toward the crown member 112 in the club head structure 100, as generally described above. Rather than multiple pieces in each layer, if desired, a single piece construction may be provided in each layer of the club head structure 100 in which the density of the material is higher at locations in the layer toward the rear and bottom of the overall club head structure 100.

The various parts of the golf club structure 100, e.g., the sole member 102, face member 104, intermediate body members 108 and 110, and crown member 112, may be joined and fixed together (directly or indirectly) in any suitable or desired manner without departing from this invention, including in conventional manners known and used in the art. As examples, two or more of the various parts may be fixed together by adhesives, cements, welding, soldering, or other bonding techniques, by mechanical connectors (such as threads, screws, nuts, bolts, or other connectors), and the like. If desired, the side edges of the various parts of the club head structure 100 (e.g., the edges where sole member 102, face member 104, intermediate body members 108 and 110, and/or crown member 112 contact one another at the seams shown in FIGS. 1-5) may include one or more raised ribs or tabs that fit into corresponding grooves, slots, or openings provided in the facing side edge to which it is joined. Cements, adhesives, mechanical connectors, or the like may be used in combination with the raised rib/groove structures described above to further help secure the various parts of the club head structure 100 to one another.

FIGS. 1-5 further show a receptacle 114 formed from various parts of the club head structure 100 for receiving a shaft 116. Any structure for the receptacle 114 may be used without departing from the invention, including conventional structures known and used in the art. The shaft 116 may be attached to the club head structure 100 at the receptacle 114 and/or at other locations in any suitable or desired manner, including in conventional manners known and used in the art, such as via adhesives, cements, welding, mechanical connectors (such as threads, retaining elements, or the like), etc. The shaft 116 may extend all the way through the club head structure 100, or it may terminate at some point between the receptacle 114 and the bottom, side, or front of the club head structure 100. Of course, the shaft 116 may be made from any suitable or desired materials, including conventional materials known and used in the art, such as graphite based materials, other composite materials, steel materials (including stainless steel), aluminum materials, and the like.

In some examples, rather than providing a raised area extending from the club head body for receptacle 114, the receptacle 114 may simply be in the form of an opening that allows the shaft 116 to be inserted into and fixed to the club head structure 100. As another example, if desired, the receptacle 114 (or at least some portion of it) may be recessed into and/or otherwise provided in the internal hollow portion of the club head structure 100. As still another example, the receptacle may be provided as part of the sole member 100 structure (e.g., as a threaded region, etc.). The shaft 116 also may extend completely through the club head structure 100 and/or terminate flush (or substantially flush) with a bottom surface 106 of the sole member 102, in at least some examples of this invention. Of course, any manner of attaching a shaft 116 to a club head structure 100 may be used without departing from this invention.

Also, as described above, a grip member (not shown) may be attached to the far end of the shaft 116 to act as a handle for the overall club. Any desired grip materials may be used without departing from this invention, including rubber materials, leather materials, materials including cord or other fabric material embedded therein, polymeric materials, and the like. The grip member may be attached to the shaft 116 in any suitable or desired manner, including in conventional manners known and used in the art, e.g., using adhesives or cements.

Various examples of potential structural materials for the various parts of the club head structure 100 are described above. As some more specific examples, the club head structure 100 may be in form of a "wood-type" golf club in which the sole member 102 and face member are made from titanium alloy materials, the first intermediate body member 108 is made from an aluminum alloy ribbon material, the second intermediate body member 110 is made from a magnesium alloy ribbon material, and the crown member 112 is made from a carbon fiber material. As another more specific example, the club head structure 100 may be in form of a "wood-type" golf club in which the sole member 102 and face member are made from steel alloy materials, the first intermediate body member 108 is made from an aluminum alloy ribbon material, the second intermediate body member 110 is made from a magnesium alloy ribbon material, and the crown member 112 is made from a carbon fiber material. Of course, other combinations of materials that satisfy the general density parameters described above may be used without departing from the invention.

Aspects of this invention also may be used advantageously with various "wood-type" golf club structures, including, for example, drivers, as well as fairway woods, hybrid or utility clubs, "iron-woods," and the like. Aspects of the invention also may be used in producing irons and the like for hitting golf balls without departing from the invention. Additionally, aspects of the invention also may be used in producing devices for hitting balls and/or objects other than golf balls. For example, aspects of the invention advantageously may be used in forming: mallets used in polo or croquet; hockey sticks (field hockey or ice hockey); and the like.

D. CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A wood-type golf club head, comprising:

a sole member made, at least in part, from a first material having a first density, wherein the first material includes at least one member selected from the group consisting of a steel material, a titanium alloy, and a polymeric material;

a first intermediate body member made, at least in part, from a second material having a second density, wherein the second density is less than the first density, and wherein the second material includes at least one member selected from the group consisting of a magnesium alloy, an aluminum alloy, a titanium alloy, and a polymeric material;

a crown member made, at least in part, from a third material having a third density, wherein the third density is less than the second density, and wherein the third material includes at least one member selected from the group consisting of a carbon fiber composite material, a glass fiber composite material, a titanium alloy material, and a polymeric material, and wherein the first intermediate body member is located between the sole member and the crown member; and a face member, wherein the sole member, the first intermediate body member, and the crown member connect to the face member;

wherein the golf club head has a hollow interior.

2. A golf club head according to claim 1, further comprising:

a second intermediate body member located between the first intermediate body member and the crown member.

3. A golf club head according to claim 1, wherein the face member is integrally formed with at least a portion of the sole member.

4. A golf club head according to claim 1, wherein the face member is made, at least in part, from a titanium alloy.

5. A golf club head according to claim 1, wherein the first material includes a titanium alloy.

6. A golf club head according to claim 1, wherein a major portion of the sole member is made from the first material, a major portion of the first intermediate body member is made from the second material, and a major portion of the crown member is made from the third material.

7. The golf club head of claim 1, wherein the first material has a front portion located adjacent to the face member and a rear portion located opposite the front portion and adjacent to a rear of the golf club head, the front portion having a density less than the rear portion.

8. A golf club, comprising:

a hollow, wood-type club head including: (a) a sole member made, at least in part, from a first material having a first density, wherein the first material includes at least one member selected from the group consisting of a steel material, a titanium alloy, and a polymeric material; (b) a first intermediate body member made, at least in part, from a second material having a second density, wherein the second density is less than the first density, and wherein the second material includes at least one member selected from the group consisting of a magnesium alloy, an aluminum alloy, a titanium alloy, and a polymeric material; (c) a crown member made, at least in part, from a third material having a third density, wherein the third density is less than the second density, and wherein the third material includes at least one member selected from the group consisting of a carbon fiber composite material, a glass fiber composite material, a titanium alloy material, and a polymeric material, and wherein the first intermediate body member is located between the sole member and the crown member; and (d) a face member, wherein the sole member, the first intermediate body member, and the crown member connect to the face member; and a shaft extending from the club head.

9. A golf club according to claim 8, wherein the club head further includes a second intermediate body member located between the first intermediate body member and the crown member.

10. A golf club according to claim 8, wherein the face member is integrally formed with at least a portion of the sole member.

11. A golf club according to claim 8, wherein the face member is made, at least in part, from a titanium alloy.

12. A golf club according to claim 8, wherein the first material includes a titanium alloy.

13. A golf club according to claim 8, wherein the shaft includes a graphite based material.

14. A golf club according to claim 8, wherein the shaft includes a steel material.

15. A golf club according to claim 8, further comprising:

a grip element attached to the shaft.

16. A golf club according to claim 8, wherein a major portion of the sole member is made from the first material, a major portion of the first intermediate body member is made from the second material, and a major portion of the crown member is made from the third material.

17. The golf club of claim 8, wherein the first material has a front portion located adjacent to the face member and a rear portion located opposite the front portion and adjacent to a rear of the golf club head, the front portion having a density less than the rear portion.

* * * * *